US006016639A

United States Patent [19]

Spencer

[11] Patent Number: 6,016,639

[45] Date of Patent: Jan. 25, 2000

[54] ICE CREAM SANDWICH WRAPPING APPARATUS HAVING A FRICTION MEMBER

[75] Inventor: Jack D. Spencer, Westerville, Ohio

[73] Assignee: Norse Dairy Systems, Columbus, Ohio

[21] Appl. No.: 09/033,542

[22] Filed: Mar. 2, 1998

[51] Int. Cl.[7] ..... B65B 11/06; B65B 49/08

[52] U.S. Cl. ..... 53/230; 53/228

[58] Field of Search ..... 53/228, 229, 230, 53/231, 232, 387.2, 387.3, 387.1, 218; 100/179, 220

[56] References Cited

U.S. PATENT DOCUMENTS

| | | | |
|---|---|---|---|
| 2,139,928 | 12/1938 | Blewett | 100/220 |
| 3,110,144 | 11/1963 | Johansen et al. | 53/232 |
| 3,810,344 | 5/1974 | Evans et al. | 53/252 |
| 3,828,660 | 8/1974 | Mueller et al. | 53/550 |
| 3,834,119 | 9/1974 | Armitt et al. | 53/230 |
| 4,023,484 | 5/1977 | Schafer et al. | 100/220 |
| 4,078,362 | 3/1978 | Ellis | 53/222 |
| 4,098,057 | 7/1978 | Holcomb | 53/371.3 |
| 4,244,158 | 1/1981 | Nelham | 53/412 |
| 4,628,664 | 12/1986 | Price . | |
| 5,205,703 | 4/1993 | Shill et al. | 414/796 |
| 5,327,706 | 7/1994 | Skole | 53/587 |
| 5,437,142 | 8/1995 | Akiyama et al. | 53/415 |
| 5,493,957 | 2/1996 | Kennedy et al. | 53/232 |

*Primary Examiner*—Stephen F. Gerrity
*Attorney, Agent, or Firm*—Standley & Gilcrest LLP

[57] ABSTRACT

The apparatus uses a single, simple movement of a shoe to wrap the rear bottom tuck panel underneath the ice cream sandwich and to push the ice cream sandwich onto a conveyor surface. In addition, the apparatus utilizes at least one friction member to actively engage the ice cream sandwich while the shoe withdraws after pushing the ice cream sandwich onto the conveyor surface.

14 Claims, 4 Drawing Sheets

ICE CREAM SANDWICH WRAPPING APPARATUS HAVING A FRICTION MEMBER

BACKGROUND OF THE INVENTION

The present invention relates generally to an improved apparatus for wrapping ice cream sandwiches. Machines for continuously and automatically producing and wrapping ice cream sandwiches are known in the art. U.S. Pat. No. 4,628,664 addresses the shortcomings of known ice cream sandwich machines. Therefore, the entire disclosure of U.S. Pat. No. 4,628,664 is incorporated herein by reference.

U.S. Pat. No. 4,628,664 teaches an ice cream sandwich machine having an elevator, a conveyor, and a shoe. The elevator includes a platform having a supporting surface for supporting an ice cream sandwich. The elevator raises the ice cream sandwich to a wrapping position at which a wrap extends over the top of and is draped along the sides of the ice cream sandwich. The conveyor is positioned adjacent to the platform and includes a conveyor surface substantially coplanar with the supporting surface such that the ice cream sandwich can be pushed from the supporting surface to the conveyor surface. The conveyor surface includes at least one recessed section which is open at an end adjacent to the platform. The shoe of U.S. Pat. No. 4,628,664 is movable in a direction toward and into abutment with the ice cream sandwich when the ice cream sandwich is on the supporting surface of the elevator. The shoe includes a rear tucker for wrapping a rear bottom tuck panel of the wrap about the ice cream sandwich as the shoe travels in the direction toward the ice cream sandwich. The shoe also includes a pusher which is fixedly connected with the rear tucker for pushing the ice cream sandwich from the supporting surface onto the conveyor surface during continued movement in the direction toward and into abutment with the ice cream sandwich. As the pusher pushes the ice cream sandwich onto the conveyor surface, the rear tucker extends into the at least one recessed section. In this manner, U.S. Pat. No. 4,628,664 uses a single movement and a single shoe for both wrapping the ice cream sandwich and pushing the ice cream sandwich onto the conveyor.

Similar to known ice cream sandwich wrapping machines such as the one taught by U.S. Pat. No. 4,628,664, it is an object of the present invention to use a single, simple movement of a shoe to wrap a rear bottom tuck panel underneath an ice cream sandwich and to push the ice cream sandwich onto a conveyor surface. However, unlike U.S. Pat. No. 4,628,664 and all other known ice cream sandwich wrapping machines, it is an object of the present invention to have friction members actively engage the ice cream sandwich while the shoe withdraws after pushing the ice cream sandwich onto the conveyor surface. It is still another object of the present invention to simplify the design and movement of the shoe. Finally, it is yet another object of the present invention to eliminate the recessed sections on the conveyor surface.

SUMMARY OF THE INVENTION

The present invention relates generally to an improved apparatus for wrapping an ice cream sandwich with a wrap having a rear bottom tuck panel. A preferred embodiment of the apparatus generally comprises an elevator, a conveyor, a shoe, conveyor walls, and a friction member. The elevator includes a platform which has a supporting surface for supporting the ice cream sandwich. The elevator raises the ice cream sandwich upwardly from a supply position at which the ice cream sandwich is supplied to the elevator to a wrapping position at which a wrap extends over the top of and is draped along the sides of the ice cream sandwich. The conveyor is positioned substantially adjacent to the platform when the elevator is moved to the wrapping position. The conveyor includes a conveyor surface which is substantially coplanar with the supporting surface when the elevator is moved to the wrapping position. When the elevator is moved to the wrapping position, the ice cream sandwich can be pushed from the supporting surface to a conveyor position on the conveyor surface. The shoe is movable in a first direction toward and into abutment with the ice cream sandwich when the ice cream sandwich is supported on the supporting surface in the wrapping position. The shoe includes a rear tucker for wrapping a rear bottom tuck panel of the wrap underneath the ice cream sandwich as the shoe travels in the direction toward the ice cream sandwich. The shoe also includes a pusher which is fixedly connected to the rear tucker for pushing the ice cream sandwich from the supporting surface onto the conveyor surface during continued movement in the direction toward and into abutment with the ice cream sandwich. The conveyor walls extend substantially perpendicular to and on opposite sides of the conveyor surface. Each of the conveyor walls has an inner surface. The inner surfaces substantially define the outer boundaries of a frictional path. A friction member is adapted to extend into the frictional path and engage the ice cream sandwich when the ice cream sandwich is in the conveyor position. As a result, the friction member resists movement of the ice cream sandwich in a direction opposite the first direction. A preferred embodiment of the apparatus may further include an actuator for moving the shoe in the first direction toward and into abutment with the ice cream sandwich.

The friction member may take different forms. In one embodiment of the present invention, the friction member extends into the frictional path from the inner surface of one of the conveyor walls. In another embodiment of the present invention, a conveyor wall has an aperture, and the friction member is adapted to extend through the aperture and into the frictional path.

Regardless of the embodiment of the friction member, the friction member may include a rubber member which is adapted to engage the ice cream sandwich when the ice cream sandwich is in the conveyor position. Likewise, the friction member may include a toothed member which is adapted to engage the ice cream sandwich when the ice cream sandwich is in the conveyor position. The toothed member may include teeth which are adapted to resist movement of the ice cream sandwich in a direction opposite the first direction regardless of the position along the side of the ice cream sandwich the teeth encounter the ice cream sandwich. In addition, the toothed member may be connected to a resilient member. The resilient member may include a spring. The resilient member is adapted to urge the toothed member into contact with the ice cream sandwich when the ice cream sandwich is in the conveyor position.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to an improved apparatus for wrapping ice cream sandwiches. In performing this function, the apparatus of the present invention uses a single, simple movement of a shoe to wrap a rear bottom tuck panel underneath an ice cream sandwich and to push the ice cream sandwich onto a conveyor surface. In addition, the apparatus utilizes at least one friction member to actively engage the ice cream sandwich while the shoe withdraws after pushing the ice cream sandwich onto the conveyor surface.

Figure 1:
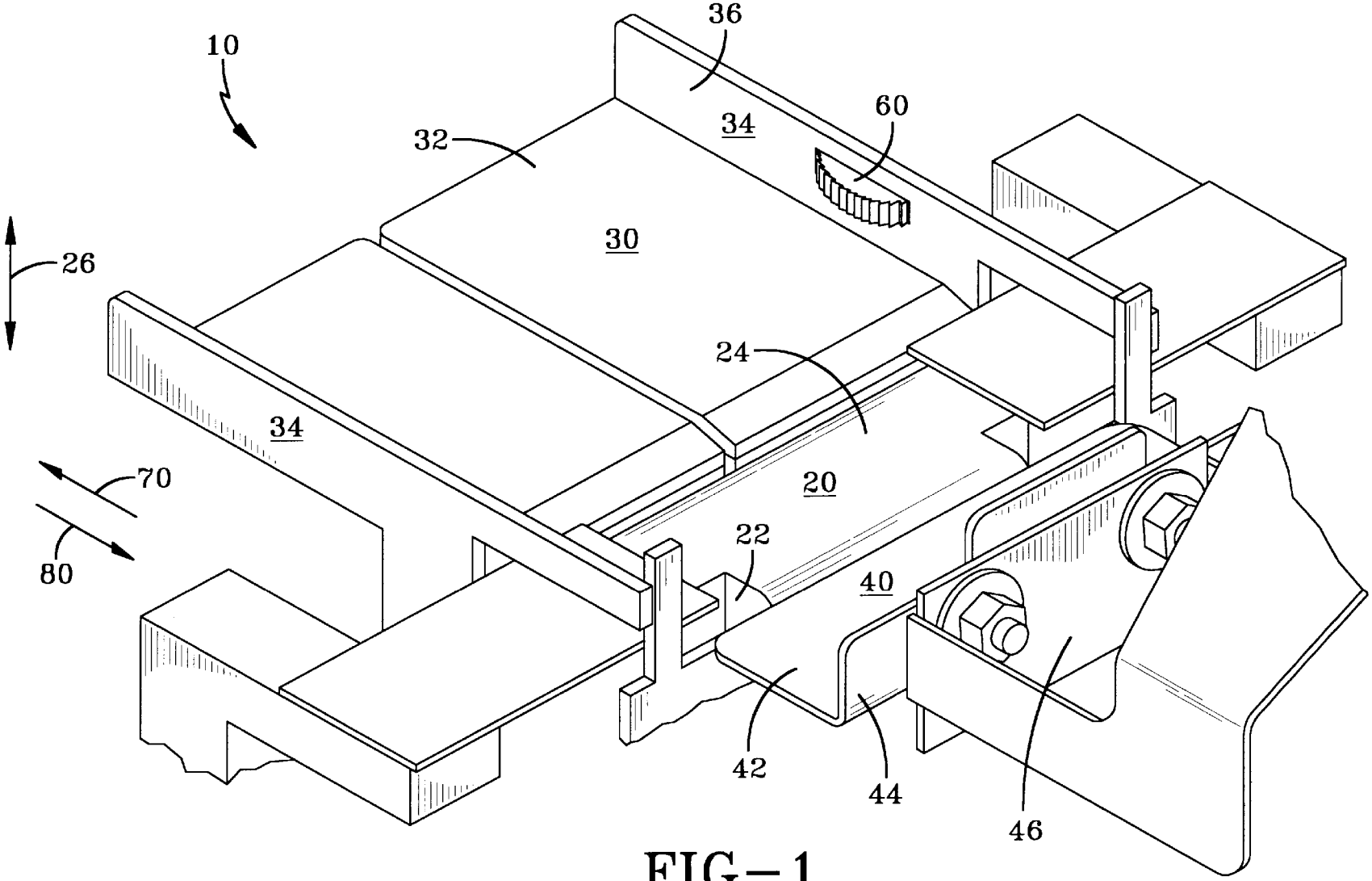
FIG. 1 is a perspective view of a preferred embodiment of the apparatus of the present invention.
Figure 2:
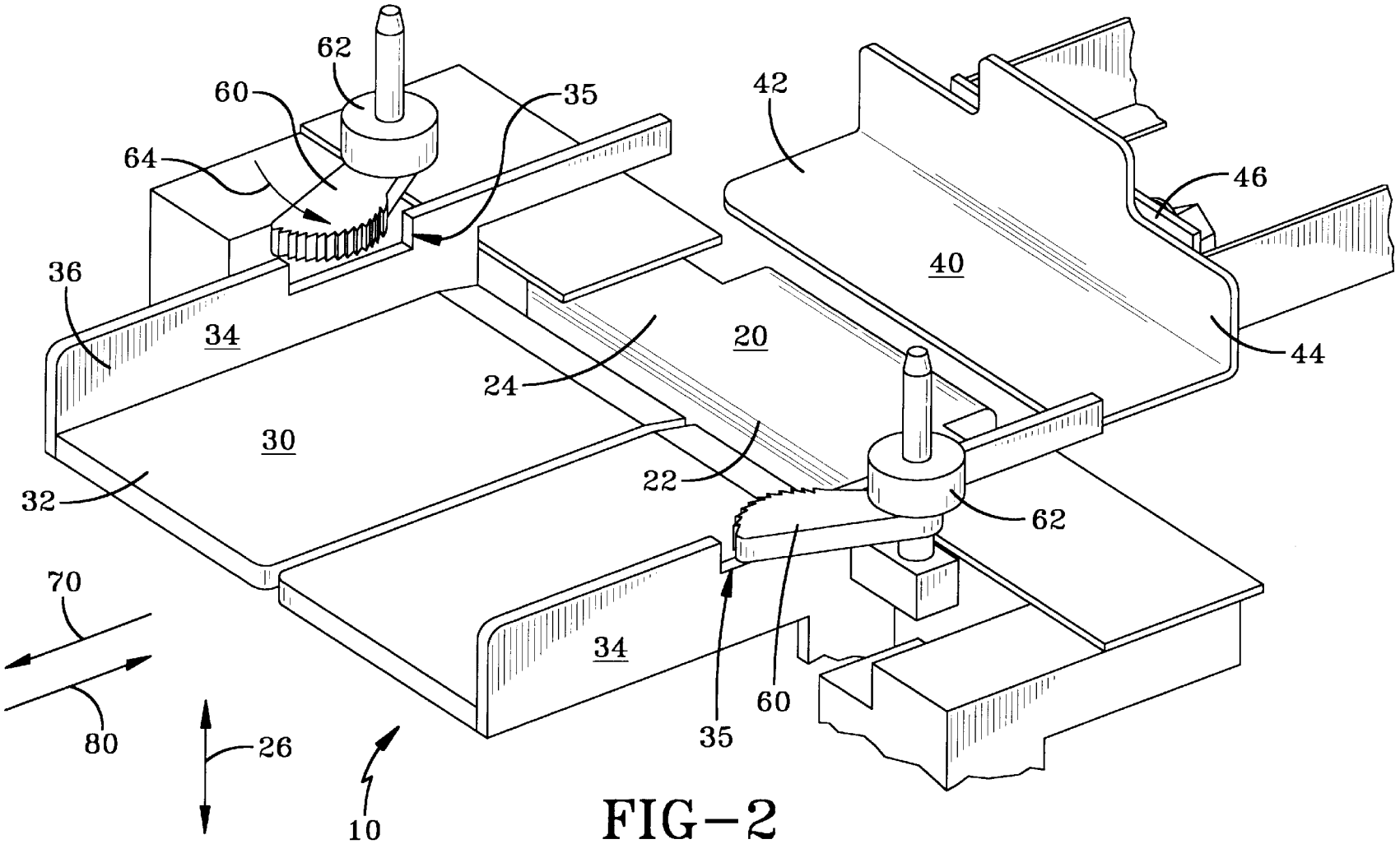
FIG. 2 is a perspective view of another preferred embodiment of the apparatus of the present invention.

FIG. 1 illustrates a perspective view of a preferred embodiment of the apparatus 10 of the present invention. FIG. 2 illustrates a perspective view of another preferred embodiment of the apparatus 10 of the present invention. In general, the apparatus 10 includes an elevator 20, a conveyor 30, a shoe 40, conveyor walls 34, and a friction member 60. The elevator 20 includes a platform 22 which has a supporting surface 24 for supporting an ice cream sandwich. The elevator 20 may further include a support shaft. The support shaft may be secured to the bottom of the platform 22 by any conventional means. The elevator 20 is movable in the directions shown by arrow 26. As a result, the platform 22 is movable between a supply position at which an ice cream sandwich is placed on the supporting surface 24 and a wrapping position.

A wrap may be placed on the top of the ice cream sandwich by any conventional means. For instance, the top of the ice cream sandwich may hit against the wrap as the platform 22 moves upwardly to the wrapping position. The platform 22 may then continue to move upward and pass through two vertical guides. The two vertical guides bend the wrap such that the wrap extends over the top of and is draped along the sides of the ice cream sandwich. When the platform 22 reaches the wrapping position, the side panels of the wrap extend to positions lower than the bottom of the ice cream sandwich.

FIGS. 1 and 2 show perspective views of a preferred embodiment of the shoe 40. The shoe 40 includes a rear tucker 42 and a pusher 44. The rear tucker 42 may be secured to the lower end of the pusher 44. The shoe 40 may also include an actuator plate 46. The actuator plate 46 may be secured to the rear of the pusher 44. The actuator plate 46 may be controlled by an actuator. The actuator may be used to move the shoe 40 in the directions shown by arrows 70 and 80. Furthermore, the actuator may include any suitable means such as a motor-controlled linkage assembly, or the actuator may have a configuration similar to the assembly of U.S. Pat. No. 4,098,057.

Referring primarily to FIGS. 1 and 2, the conveyor 30 is positioned substantially adjacent to the platform 22 when the elevator 20 is moved to the wrapping position. The conveyor 30 includes a conveyor surface 32 which is substantially coplanar with the supporting surface 24 when the platform 22 is moved to the wrapping position. At the wrapping position, an ice cream sandwich may be pushed from the supporting surface 24 to a conveyor position on the conveyor surface 32. In a preferred embodiment of the present invention, conveyor walls 34 extend substantially perpendicular to and on opposite sides of the conveyor surface 32. Each of the conveyor walls 34 has an inner surface 36. The inner surfaces 36 substantially define the outer boundaries of a frictional path. At least one friction member 60 is adapted to extend into the frictional path and engage the ice cream sandwich when the ice cream sandwich is in the conveyor position. As a result, at least one friction member 60 resists movement of the ice cream sandwich in the direction indicated by arrow 80.

As shown in FIG. 1, a friction member 60 may extend into the frictional path from the inner surface 36 of a conveyor wall 34. FIG. 2 depicts another embodiment of a friction member 60. In FIG. 2, conveyor wall 34 has an aperture 35, and a friction member 60 is adapted to extend through the aperture 35 and into the frictional path.

Regardless of the embodiment of a friction member 60, a friction member 60 may include a toothed member which is adapted to engage the ice cream sandwich when the ice cream sandwich is in the conveyor position. Variations of this feature are shown in FIGS. 1 and 2. The toothed member preferably includes teeth which are adapted to resist movement of the ice cream sandwich in the direction indicated by arrow 80 regardless of the position along the side of the ice cream sandwich the teeth encounter the ice cream sandwich.

In addition, a friction member 60 is preferably connected to a resilient member 62. One embodiment of this feature is shown in FIG. 2. However, it should also be recognized that a friction member 60 which extends from the inner surface 36 of a conveyor wall 34 is also preferably connected to a resilient member 62.

Embodiments of the apparatus 10 which utilize a resilient member 62 are preferred over those embodiments which do not. In particular, a resilient member 62 is adapted to urge the friction member 60 into contact with the ice cream sandwich when the ice cream sandwich is in the conveyor position. For example, in the embodiment shown in FIG. 2, the resilient member 62 is adapted to urge the friction member 60 to move in the direction indicated by arrow 64 through the aperture 35 and into the frictional path in order to engage the ice cream sandwich. Moreover, a resilient member 62 is preferably adapted to allow the friction member 60 to adequately retract when the ice cream sandwich is pushed into the conveyor position. As a result, a resilient member 62 may limit unnecessary pressure against the ice cream sandwich.

Movement of a resilient member 62 may be electronically-controlled such as by an electromechanical control system. Conversely, movement of a resilient member 62 may be mechanically-controlled. Accordingly, a resilient member 62 may include an elastic or flexible member such as a spring, a spring-loaded mechanism, or any similar mechanical device which may be adapted to urge the friction member 60 into contact with the ice cream sandwich when the ice cream sandwich is in the conveyor position.

It should be recognized that a friction member 60 may engage any side, end, and/or edge of the ice cream sandwich in order to resist movement of the ice cream sandwich in the direction indicated by arrow 80. It should also be recognized that the apparatus 10 may have a plurality of friction members 60. In fact, as shown in FIG. 2, the apparatus 10 preferably has a plurality of friction members 60 in order to engage opposing sides, ends, and/or edges of the ice cream sandwich.

A friction member 60 may be made from any material which is suitable for engaging an ice cream sandwich. A preferred embodiment of a friction member 60 may include a rubber member which is adapted to engage the ice cream sandwich when the ice cream sandwich is in the conveyor position. Nonetheless, patentability is not dependent on the material composition of a friction member 60.

Figure 3:
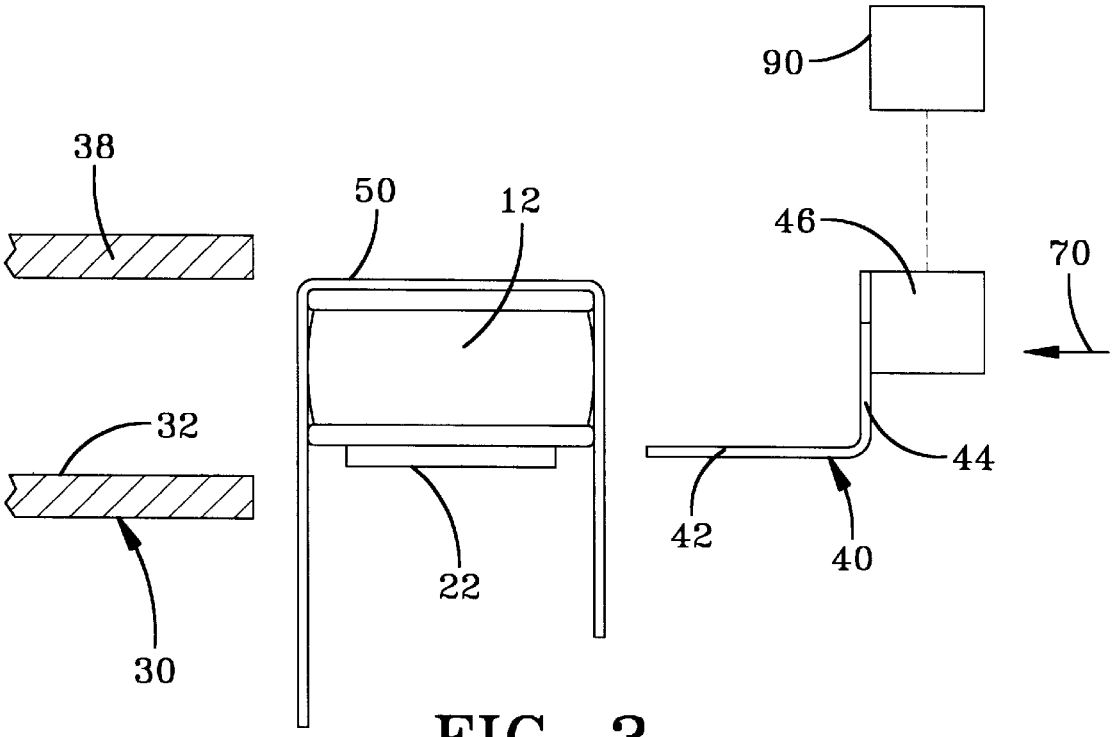
FIG. 3 is a cross-section view showing a first action sequence of yet another preferred embodiment of the apparatus of the present invention.

The operation of one embodiment of the apparatus 10 is depicted in FIGS. 3 through 6. For simplicity, the support shaft and vertical guides are not shown in FIGS. 3 though 6. FIG. 3 does, however, show an upper limit member 38 and an actuator 90. The apparatus 10 may include an upper limit member 38 in order to hold down ice cream sandwiches 12 which are traveling on the conveyor 30. A preferred embodiment of the upper limit member 38 may be connected to the conveyor walls 34. For simplicity, the actuator 90 is not shown in FIGS. 4 through 6.

FIG. 3 is a cross-section view showing an ice cream sandwich 12 which has been lifted through vertical guides to the wrapping position by the platform 22. The vertical guides have bent a wrap 50 such that the wrap 50 extends over the top of and is draped along the sides of the ice cream sandwich 12. After the ice cream sandwich 12 has reached the wrapping position, a shoe 40 moves in the direction indicated by arrow 70.

Figure 4:
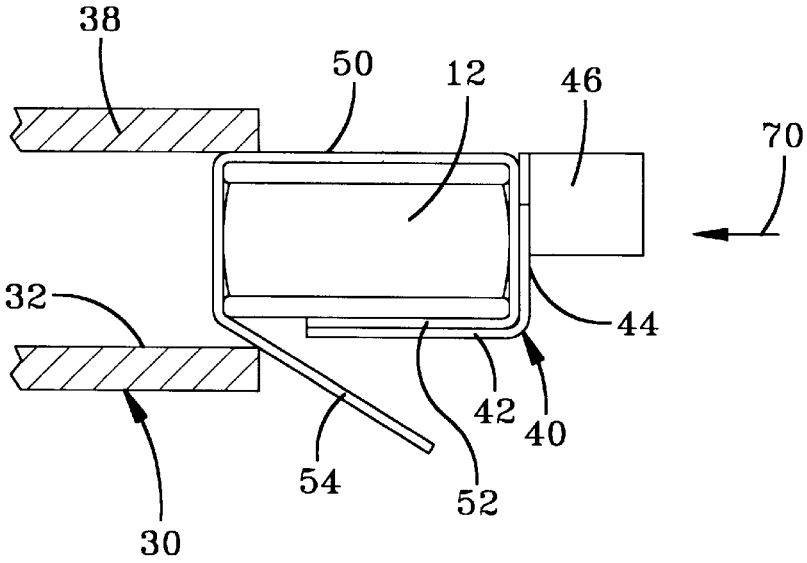
FIG. 4 is a cross-section view showing a second action sequence of the apparatus shown in FIG. 3 in which the shoe wraps the rear bottom tuck panel underneath the ice cream sandwich.

Referring to FIG. 4, the platform 22 begins to descend as the shoe 40 approaches from the direction indicated by arrow 70. As the platform 22 descends, the rear tucker 42 engages the bottom of the ice cream sandwich 12. As the platform 22 continues to descend, the rear tucker 42 provides support for the ice cream sandwich 12 and tucks a rear bottom tuck panel 52 of the wrap 50 underneath the ice cream sandwich 12. After the position shown by FIG. 4 is obtained, the platform 22 is completely lowered, and the ice cream sandwich 12 is supported solely by the rear tucker 42.

Figure 5:
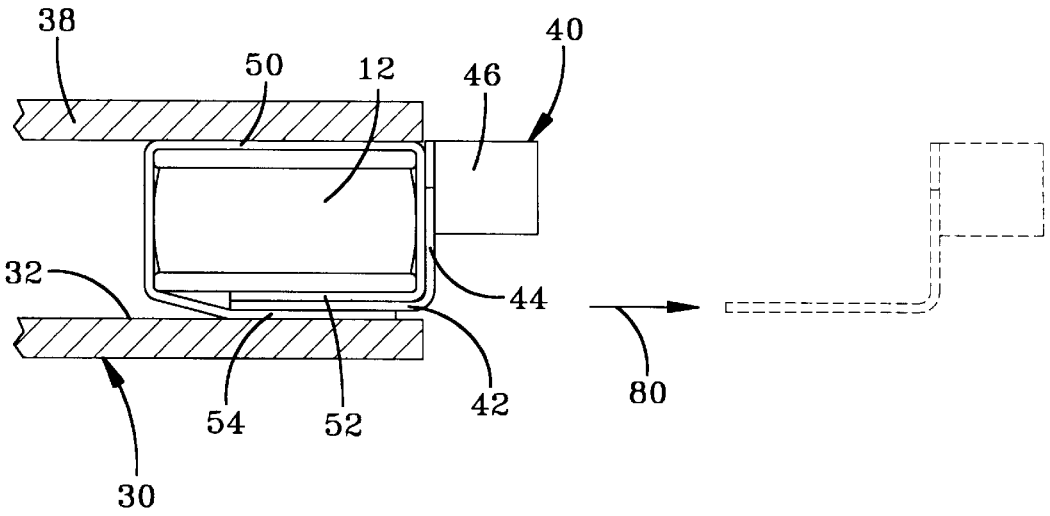
FIG. 5 is a cross-section view showing a third action sequence of the apparatus shown in FIG. 3 in which the shoe withdraws after pushing the ice cream sandwich onto the conveyor surface.
Figure 6:
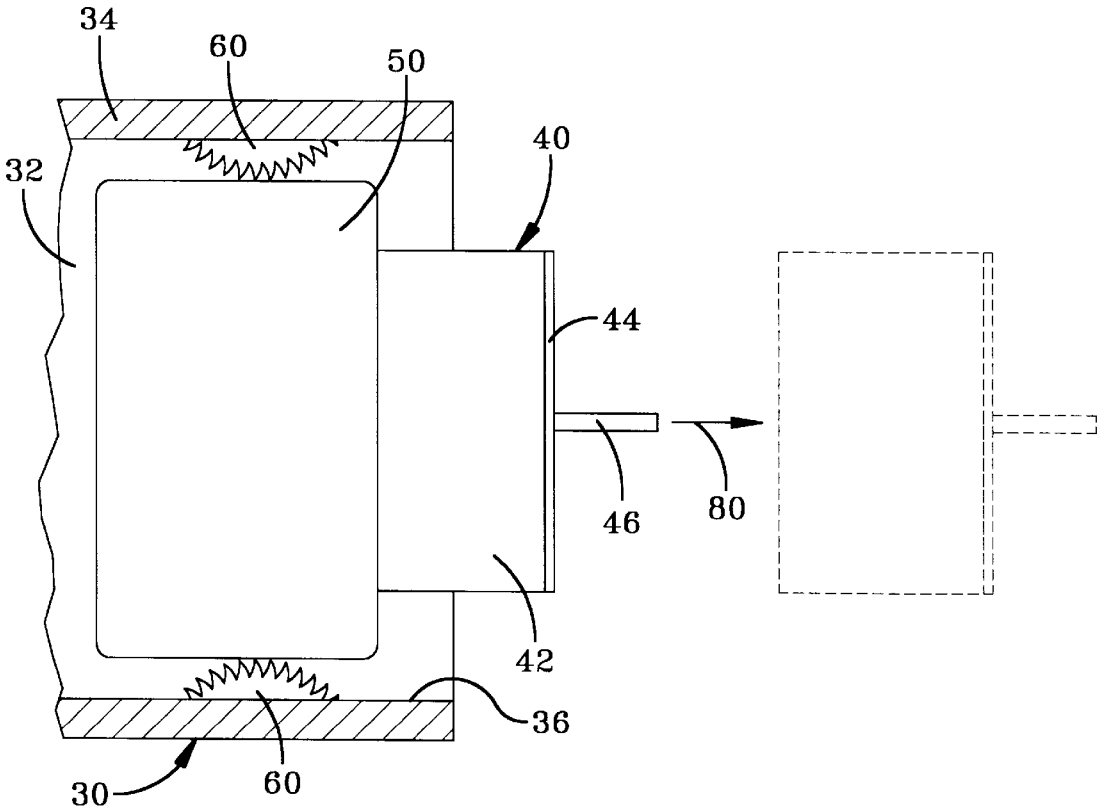
FIG. 6 is a top plan view showing a final action sequence of the apparatus shown in FIG. 3 in which the friction members engage the ice cream sandwich while the shoe withdraws after pushing the ice cream sandwich onto the conveyor surface.

Referring primarily to FIGS. 4, 5, and 6, the shoe 40 continues to move in the direction indicated by arrow 70, and the pusher 44 abuts against a side of the ice cream sandwich 12 and pushes the ice cream sandwich 12 onto the conveyor surface 32 of the conveyor 30. Since the pusher 44 is connected to the rear tucker 42, a single movement of the shoe 40 wraps the rear bottom tuck panel 52 underneath the ice cream sandwich 12 and pushes the ice cream sandwich 12 onto the conveyor surface 32. As the ice cream sandwich 12 is pushed onto the conveyor surface 32, a front bottom tuck panel 54 of the wrap 50 is tucked underneath the ice cream sandwich 12 and around the rear tucker 42 by the conveyor surface 32.

The friction members 60 extending from the conveyor walls 34 engage the ice cream sandwich 12 when the ice cream sandwich 12 is in the conveyor position on the conveyor surface 32. In order to depict this sequence, the upper limit member 38 is not shown in FIG. 6. After the ice cream sandwich 12 is placed in the conveyor position, the shoe 40 withdraws in the direction indicated by arrow 80. As the shoe 40 withdraws, the friction members 60 resist movement of the ice cream sandwich 12 in the direction indicated by arrow 80. In this manner, the ice cream sandwich 12 remains on the conveyor surface 32 while the shoe 40 withdraws in the direction indicated by arrow 80, and the rear bottom tuck panel 52 is not disengaged from the underneath of the ice cream sandwich 12.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An apparatus for wrapping an ice cream sandwich with a wrap, said wrap having a rear bottom tuck panel, said apparatus comprising:

an elevator for raising said ice cream sandwich upwardly from a supply position at which said ice cream sandwich is supplied to said elevator, to a wrapping position at which said wrap extends over the top of and is draped along the sides of said ice cream sandwich, said elevator including a platform having a supporting surface for supporting said ice cream sandwich;

a conveyor positioned substantially adjacent said platform when said elevator is moved to said wrapping position, said conveyor including a conveyor surface substantially coplanar with said supporting surface when said elevator is moved to said wrapping position, wherein said ice cream sandwich can be pushed from said supporting surface to a conveyor position on said conveyor surface;

a shoe movable in an infeed direction toward and into abutment with said ice cream sandwich when said ice cream sandwich is supported on said supporting surface in said wrapping position, said shoe including a rear tucker for wrapping a rear bottom tuck panel of said wrap underneath said ice cream sandwich as said shoe travels in said infeed direction toward said ice cream sandwich, and a pusher fixedly connected with said rear tucker for pushing said ice cream sandwich from said supporting surface onto said conveyor surface during continued movement in said infeed direction toward and into abutment with said ice cream sandwich;

conveyor walls extending substantially perpendicular to and on opposite sides of said conveyor surface, each of said conveyor walls having an inner surface, said inner surfaces substantially defining the outer boundaries of a frictional path; and a friction member adapted to extend into said frictional path and engage said ice cream sandwich when said ice cream sandwich is in said conveyor position, so as to resist movement of said ice cream sandwich in a direction opposite said infeed direction.

2. An apparatus according to claim 1 wherein said friction member extends into said frictional path from said inner surface of one of said conveyor walls.

3. An apparatus according to claim 2 wherein said friction member comprises a toothed member adapted to engage said ice cream sandwich when said ice cream sandwich is in said conveyor position.

4. An apparatus according to claim 3 wherein said toothed member comprises teeth adapted to resist movement of said ice cream sandwich in a direction opposite said infeed direction regardless of the position along the side of said ice cream sandwich said teeth encounter said ice cream sandwich.

5. An apparatus according to claim 3 wherein said toothed member is connected to a resilient member, said resilient member adapted to urge said toothed member into contact with said ice cream sandwich when said ice cream sandwich is in said conveyor position.

6. An apparatus according to claim 5 wherein said resilient member comprises a spring.

7. An apparatus according to claim 1 wherein one of said conveyor walls has an aperture, and wherein said friction member is adapted to extend through said aperture and into said frictional path.

8. An apparatus according to claim 7 wherein said friction member comprises a toothed member adapted to engage said ice cream sandwich when said ice cream sandwich is in said conveyor position.

9. An apparatus according to claim 8 wherein said toothed member comprises teeth adapted to resist movement of said ice cream sandwich in a direction opposite said infeed direction regardless of the position along the side of said ice cream sandwich said teeth encounter said ice cream sandwich.

10. An apparatus according to claim 8 wherein said toothed member is connected to a resilient member, said resilient member adapted to urge said toothed member into contact with said ice cream sandwich when said ice cream sandwich is in said conveyor position.

11. An apparatus according to claim 10 wherein said resilient member comprises a spring.

12. An apparatus according to claim 1 wherein said friction member comprises a rubber member adapted to engage said ice cream sandwich when said ice cream sandwich is in said conveyor position.

13. An apparatus according to claim 1 further including an actuator adapted to move said shoe in said infeed direction toward and into abutment with said ice cream sandwich.

14. An apparatus according to claim 1 wherein said infeed direction is substantially horizontal.

* * * * *